US008707731B2

(12) United States Patent
Graves Crittenden

(10) Patent No.: US 8,707,731 B2
(45) Date of Patent: Apr. 29, 2014

(54) WEARABLE DEVICE FOR JEWELRY RING STORAGE

(76) Inventor: Emily Graves Crittenden, Los Angeles, CA (US)

( * ) Notice: Subject to any disclaimer, the term of this patent is extended or adjusted under 35 U.S.C. 154(b) by 93 days.

(21) Appl. No.: 13/287,875

(22) Filed: Nov. 2, 2011

(65) Prior Publication Data

US 2013/0104600 A1 May 2, 2013

(51) Int. Cl.
*A44C 25/00* (2006.01)

(52) U.S. Cl.
USPC ..... 63/1.18; 63/3; 63/23

(58) Field of Classification Search
USPC ..... 224/257, 255, 268, 603–605; 63/1.11, 63/1.18, 40, 3, 23; 206/6.1; 24/3.13; 248/690–693, 689
See application file for complete search history.

(56) References Cited

U.S. PATENT DOCUMENTS

| | | | | | |
|---|---|---|---|---|---|
| 1,141,992 | A | | 6/1915 | Toelcke | |
| 1,590,172 | A | | 6/1926 | Thorberg | |
| 2,273,136 | A | * | 2/1942 | Orech et al. | 224/258 |
| 2,665,042 | A | | 1/1954 | Starolis | |
| 3,014,298 | A | | 12/1961 | Kirshner | |
| 4,028,908 | A | * | 6/1977 | Michael | 63/23 |
| 4,220,017 | A | * | 9/1980 | Freeman | 63/15 |
| 4,265,098 | A | | 5/1981 | Wayne | |
| 4,430,869 | A | | 2/1984 | Zinni | |
| 4,516,708 | A | | 5/1985 | Elliott | |
| 4,632,351 | A | | 12/1986 | Coon | |
| 4,795,069 | A | * | 1/1989 | Ferrill | 224/605 |
| 4,974,429 | A | | 12/1990 | Ferrara | |
| 5,758,516 | A | | 6/1998 | Uematsu | |
| 6,293,034 | B1 | | 9/2001 | Skapyak | |
| 7,188,493 | B2 | | 3/2007 | Conway | |
| 2006/0042313 | A1 | * | 3/2006 | Mattiacci | 63/1.18 |
| 2006/0185393 | A1 | | 8/2006 | Cherry | |

FOREIGN PATENT DOCUMENTS

| | | |
|---|---|---|
| JP | 2008093324 | 4/2008 |
| JP | 2008113970 | 5/2008 |
| JP | 2008212619 | 9/2008 |
| JP | 2009045106 | 10/2008 |

* cited by examiner

*Primary Examiner* — Victor Batson
*Assistant Examiner* — Abigail Morrell
(74) *Attorney, Agent, or Firm* — Zuber Lawler & Del Duca LLP

(57) ABSTRACT

The present invention relates to a mobile device and method for a secure jewelry ring holder. The improved jewelry ring holder provides a wearable storage device for displaying the jewelry ring from a chain while suspending a jewelry ring in a secure fashion. For securing, the jewelry ring is threaded onto the improved wearable storage device rather than requiring that the wearer remove or unfasten a chain, or open or unlock a clasp. The chain holds in place a wearable storage pendant. When threaded onto the wearable storage pendant the jewelry ring is stored as it rests securely on the wearable storage pendant. Curvatures located on the wearable storage pendant allow the jewelry ring to lie substantially flat against the wearer's body.

5 Claims, 12 Drawing Sheets

WEARABLE DEVICE FOR JEWELRY RING STORAGE

TECHNICAL FIELD

The present invention relates to a wearable device and method for a secure jewelry ring holder. The improved jewelry ring holder provides a wearable storage device for displaying the jewelry ring from a chain while suspending a jewelry ring in a secure fashion. For securing, the jewelry ring can be threaded onto the improved wearable storage device while the wearable storage device is being worn by the wearer, rather than requiring that the wearer remove or unfasten a chain, or open or unlock a clasp.

BACKGROUND OF THE INVENTION

Wearing a jewelry ring is not only prevalent today, but has been in vogue throughout history. People wear jewelry rings for various reasons, including for purposes of fashion, displaying marital or relationship status, or associations with groups or institutions.

Inadvertent loss of valuable jewelry is a chronic problem. Jewelry rings are removed for many reasons. The ring may irritate the wearer's finger after prolonged use; the wearer may need to wash their hands; the wearer's finger may swell temporarily (making resizing the jewelry ring impractical); or the wearer may remove the jewelry ring for participation in sports or occupational activities where retaining the jewelry ring on the wearer's finger is dangerous. Often, jewelry rings are lost when the wearer deliberately removes the jewelry ring and then puts it down, later forgetting where the jewelry ring was placed.

Jewelry rings may be dislodged inadvertently. Jewelry rings can be lost through lubrication by soap and water, where the jewelry ring then slips from the wearer's finger. Jewelry rings may also be lost by dislodging the jewelry ring from prior art wearable storage devices that contain clasps or other retaining means that fail.

Alternatively, there are persons who may not want to or cannot wear a ring, and who wish to display a ring using the necklace rather than wearing it on a finger.

However, removal and storage of a jewelry ring during the day may be impractical, or even impossible. Removal may require the wearer to anticipate situations where wearing the jewelry ring is not practical or is unsafe. Often the wearer may not be able to anticipate when the jewelry ring should be removed. Or, if removal can be anticipated, the wearer may not be able to place the jewelry ring in fixed secure storage such as a jewelry box or stationary jewelry ring holder at home. Alternatively, the jewelry ring wearer may anticipate the need to remove the jewelry ring, but choose to wear it anyway because the wearer does not having a reliable way to secure the jewelry ring during the time that it needs to be removed.

Existing wearable jewelry ring holders affixed to chains or necklaces require that the wearer first remove the chain or other device for holding the jewelry ring in order to secure the jewelry ring. Removal of existing holders is accomplished by lifting the chain or necklace over the wearer's head or by undoing a clasp on the chain. However, lifting the chain over the wearer's head can be difficult or bothersome, especially where removal would mar the wearer's clothing or hairstyle. Undoing an existing necklace or chain clasp may also be difficult for some wearers, such as those suffering from arthritis or similar conditions that make manipulation of tiny objects difficult. Similarly, operating an existing necklace or chain clasp may be undesirable for a wearer who does not wish to destroy manicured nails.

Aside from difficulties with the chain or necklace, prior art wearable jewelry ring holders often utilize clasps or other securing mechanisms that are susceptible to failure, causing the loss of the jewelry ring. Prior art wearable jewelry ring holders are also flawed because they require that the ring jut out from the wearers chest. Thus, the ring may be secured around the wearer's neck, but protruding from the wearer at an extreme angle. In some instances, the ring extending out from the wearer may be dangerous to the wearer, or may cause damage to the ring being worn.

Accordingly, a need exists for a necklace that permits the wearer to attach or remove a ring quickly and easily to a chain that can be in place already around his or her neck or wrist, without having to remove the chain at all. There further exists a need for a wearable jewelry ring holder that allows the ring to lay flat or substantially flat against the wearer's body while being worn.

The improved wearable jewelry ring storage device of the present invention is desirable to avoid the problems with prior art devices, while providing jewelry ring wearers with a wearable device and method to prevent inadvertent jewelry ring loss.

BRIEF SUMMARY OF THE INVENTION

The invention described herein is an improved device and method for a wearable jewelry ring holder. In a preferred embodiment, the wearable jewelry ring holder consists of a chain and a pendant which contains an opening that provides for a jewelry ring to be securely threaded onto the wearable storage pendant. As used in this disclosure, the term "chain" is intended to describe a chain, necklace, lanyard, or similar item made of precious or non-precious metals, cord, leather or similar flexible materials.

Attachment of the wearable storage pendant to the chain does not require that the wearer remove the chain, unclasp the chain, or unclasp or remove any jewelry-holding mechanism. In the preferred embodiment, when threaded onto the wearable storage pendant, the jewelry ring rests securely on the wearable storage pendant in proximity to the pendant's attachment to the chain. Because at least one portion of the outer dimension of the wearable storage pendant is greater than the diameter of the jewelry ring finger opening, the jewelry ring stays securely on the wearable storage pendant.

The chain may be any form that permits attachment of the wearable storage pendant. Attachment of the wearable storage pendant to the chain can be through one or more secured openings that allow the chain to pass or slide through the body of the wearable storage pendant or, alternatively, the wearable storage pendant can be attached to the chain by a separate eyelet or hook or by permanent attachment to the chain such as by soldering. Preferably attachment of the wearable storage pendant to the chain is performed prior to the wearer's anticipated need to remove the jewelry ring. The wearer is then able to wear the wearable storage pendant on the chain in anticipation of a future need to remove, secure, and store the jewelry ring safely. In this way, the wearer need only thread the jewelry ring onto the wearable storage pendant in order to secure the jewelry ring. In like manner, the wearer can remove the jewelry ring, by unthreading the ring from the wearable storage pendant.

BRIEF DESCRIPTION OF THE DRAWINGS

In the drawings, which represent the best mode presently contemplated for carrying out the invention.

DETAILED DESCRIPTION OF THE INVENTION

Figure 1:
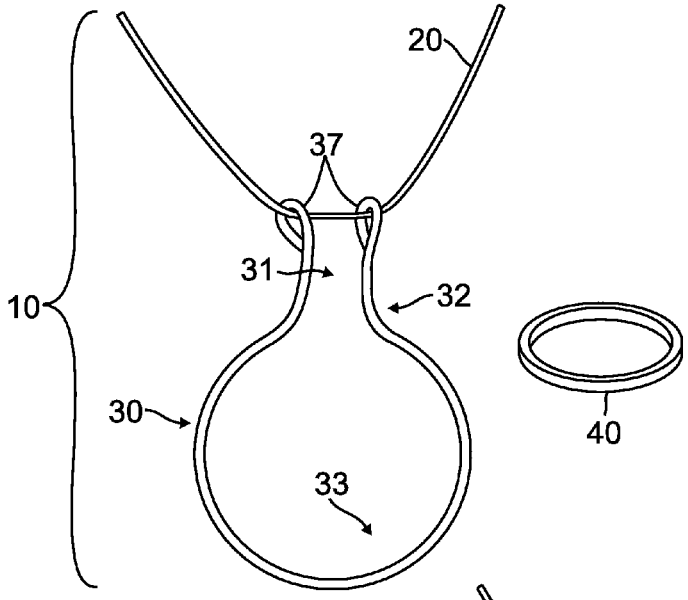
FIG. 1 is a plan view of a first preferred embodiment of the invention.

A preferred embodiment for an improved wearable device 10 for jewelry ring storage is shown in FIG. 1. The present invention includes a wearable storage pendant 30 shown in FIG. 1. The wearable storage pendant 30 comprises a rigid silhouette, with an opening 31 onto which the user can thread a jewelry ring 40. A chain 20 holds the wearable storage pendant 30 in place. For the preferred embodiment of the improved wearable device 10 for jewelry ring storage shown in FIG. 1, the chain 20 is not permanently attached to the wearable storage pendant 30. The chain 20 may be removed or replace with an alternative chain (not shown).

In the preferred embodiment shown in FIG. 1, the wearable storage pendant 30 has the general shape of a vase or bottle with a wide body and a narrow neck. The shape of the wearable storage pendant 30 is continuous except for a break or opening 31 at the top of the vase or bottle shape. The chain 20 attaches at each end of the opening 31, by passing through loops 37 either built into or affixed onto each side of the wearable storage pendant 30.

Figure 2:
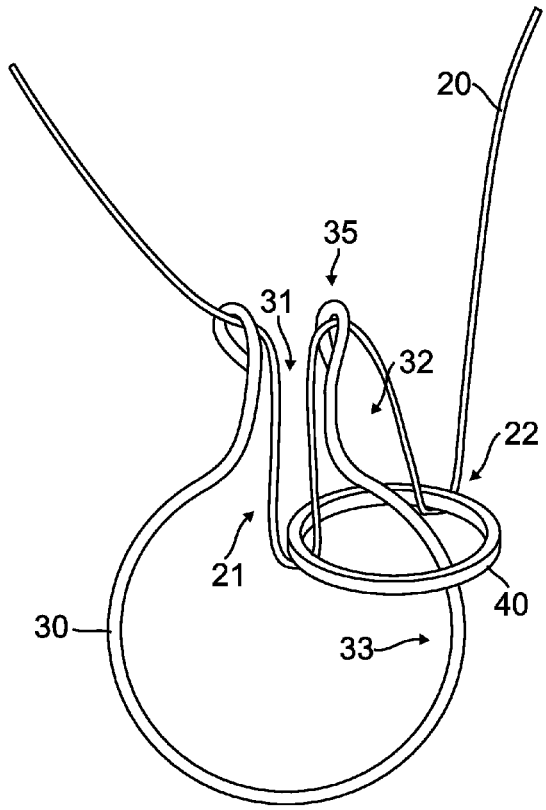
FIG. 2 is a plan view of the initial (first) stage of attaching a ring onto the first preferred embodiment of the invention.

A chain 20 is placed around a user's neck or wrist (or alternatively ankle or waist) in the same manner as placement of a conventional chain. To place the jewelry ring 40 upon wearable storage pendant 30, as shown in FIG. 2, the jewelry ring 40 is held in such a way so that the upper end 35 of the wearable storage pendant 30 begins to pierce the finger opening of the jewelry ring 40. When this occurs, a first portion 21 of the chain 20 is depressed through the opening 31 along the inner periphery 33 of the wearable storage pendant 30 and a second portion 22 of the chain 20 is pressed down by the ring 40 along the upper outside periphery 32 of the wearable storage pendant 30.

Figure 2A:
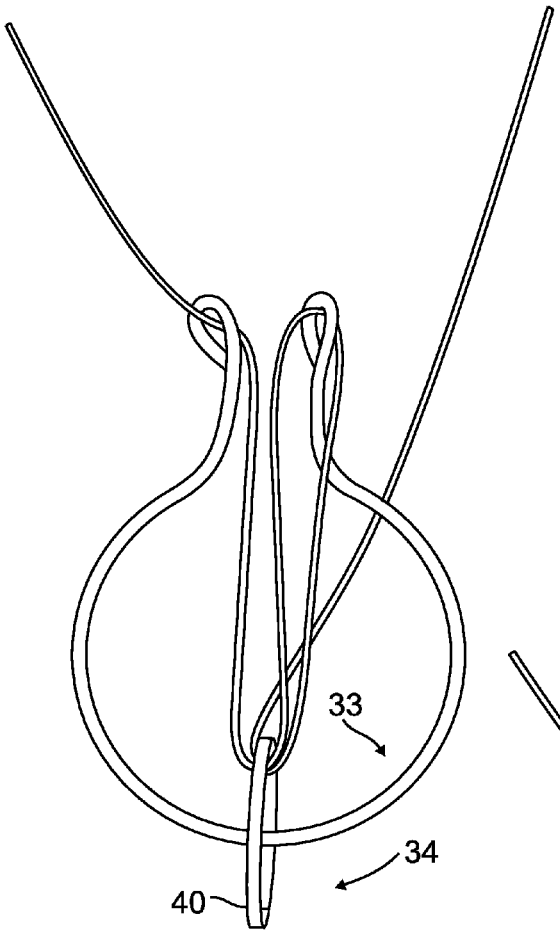
FIG. 2A is a plan view of the second stage of attaching a ring onto the first preferred embodiment of the invention.
Figure 2B:
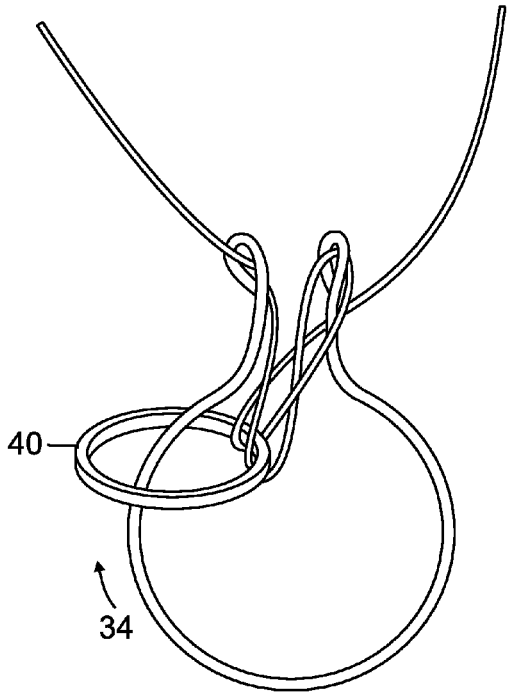
FIG. 2B is a plan view of the third stage of attaching a ring onto the first preferred embodiment of the invention.

As shown in FIG. 2A, the chain 20 is further depressed along the inner periphery 33 of the wearable storage pendant 30 and the outer periphery 34 of the wearable storage pendant 30. The jewelry ring 40 is caused to travel completely around the periphery 34 of the wearable storage pendant 30 as shown in FIG. 2B.

The jewelry ring 40 thus threads the wearable storage pendant 30, continuing to manipulate, pull, and flex the chain 20 with the edges of the jewelry ring 40 all the while. When the jewelry ring 40 completes its travel around the perimeter of the wearable storage pendant 30, the jewelry ring 40 is positioned above the attachment loops 37, with both the first portion 21 and the second portion 22 of the chain 20 located within the jewelry ring, as shown in FIG. 3.

Figure 4:
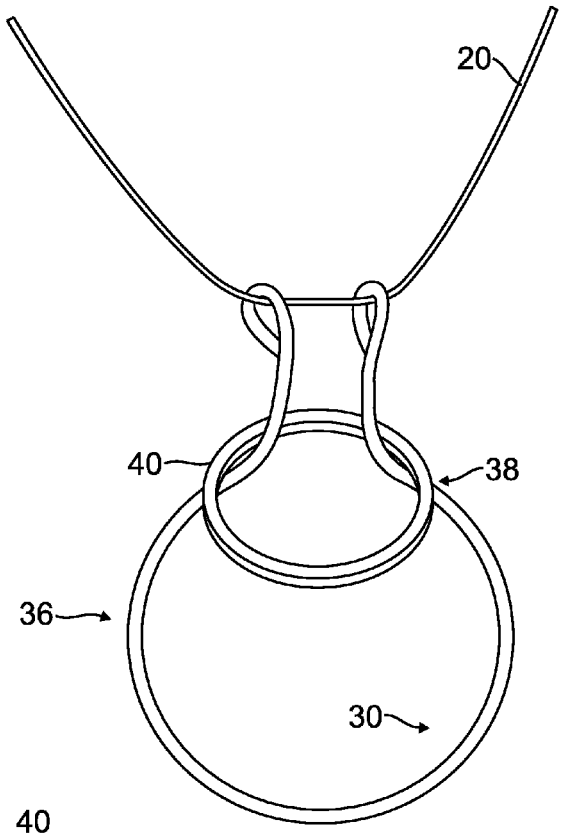
FIG. 4 is a plan view of the ring attached to the invention.

Because the widest part 36 of the wearable storage pendant 30 is now located below the ring, the jewelry ring 40 may be released. The jewelry ring 40 will come to rest on the wearable storage device 30, as shown in FIG. 4. The jewelry ring 40 is thus secured by the wearable storage pendant 30 and the chain 20, eliminating all possibility of dropping the jewelry ring 40.

Figure 3:
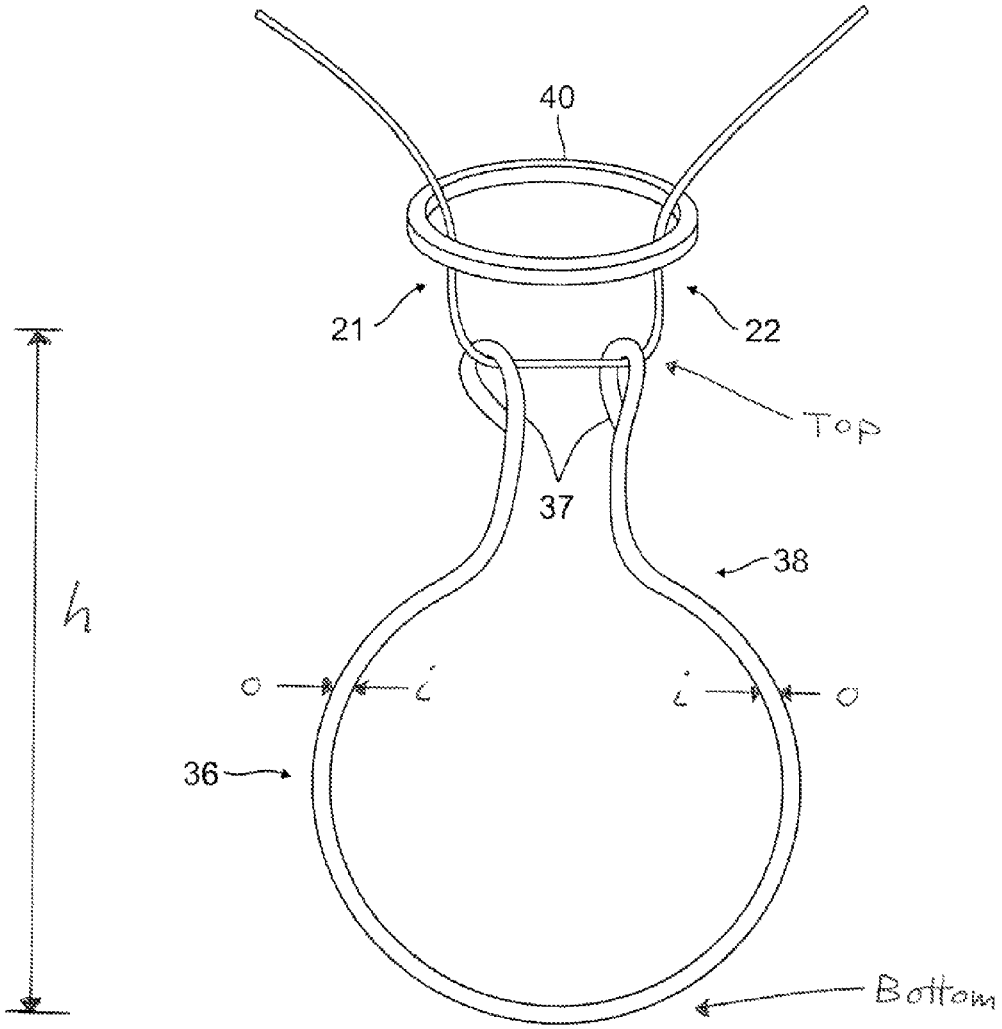
FIG. 3 is a plan view of the fourth stage of attaching a ring onto the first preferred embodiment of the invention.

The widest part of the body 36 of the wearable storage pendant 30, shown in FIGS. 3 and 4, is wider than the inside diameter of the jewelry ring 40 so that the jewelry ring 40 rests securely on the wearable storage pendant 30. Precisely where the jewelry ring 40 comes to rest on the wearable storage pendant 30 will vary based on the size of the jewelry ring 40. In the embodiment shown in FIGS. 1-4, the ring 40 will invariably come to rest on the neck 38 of the wearable storage pendant 30. FIG. 3 shows the front-side of pendant 30, with the back side of the pendant not visible behind it. The body of wearable storage pendant 30 is an elongated member having two ends (a first end and a second end) that is curved in a plane so that each of the two ends is disposed in the top portion of the pendant, forming a bottle-shaped lateral profile as shown in FIG. 3. As further shown in FIG. 3, the pendant has a vertical dimension "h" (height). The elongated member is curved so that portions (segments) of the elongate member are laterally opposite (laterally opposing) one another. For any given vertical level, laterally opposing portions of the elongate member will have inward-facing sides with a lateral distance between them (e.g., the distance between inner arrowheads "i" in FIG. 3), which defines an "inner lateral dimension" between laterally opposite portions of the member. Similarly, for any given vertical level, laterally opposing portions of the elongate member will have outward-facing sides with a lateral distance between them (e.g., the distance between arrowheads "o" in FIG. 3), which defines an "outer lateral dimension" between laterally opposite portions of the member.

To remove the jewelry ring 40 from the wearable storage device 10, the jewelry ring 40 travels in a reverse manner around the wearable storage pendant 30. Thus, the wearer is able to secure the jewelry ring 40 on the wearable storage device 10 and later remove the jewelry ring 40 from the wearable storage device 10 without manipulating clasps or removing the wearable storage device 10 or any part from the wearer's body.

The chain 20 may be any chain that can accommodate the flexing and bending action shown in FIGS. 1-4. The chain 20 may be made of precious or non-precious metals, cord, leather or similar flexible materials. The wearable storage pendant 30 may be formed of any substantially inflexible or hard material, including but not limited to precious or non-precious metals, ceramic, plastic, porcelain, gem stone, shell, stone, or wood.

Figure 5:
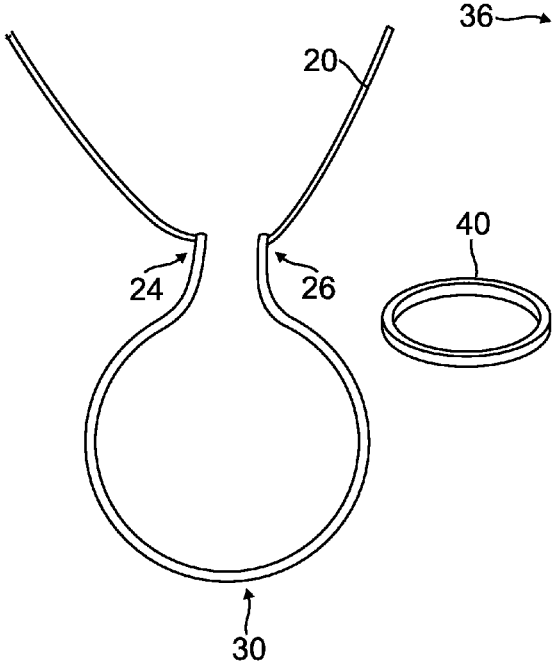
FIG. 5 is a plan view of a second preferred embodiment of the invention.
Figure 6:
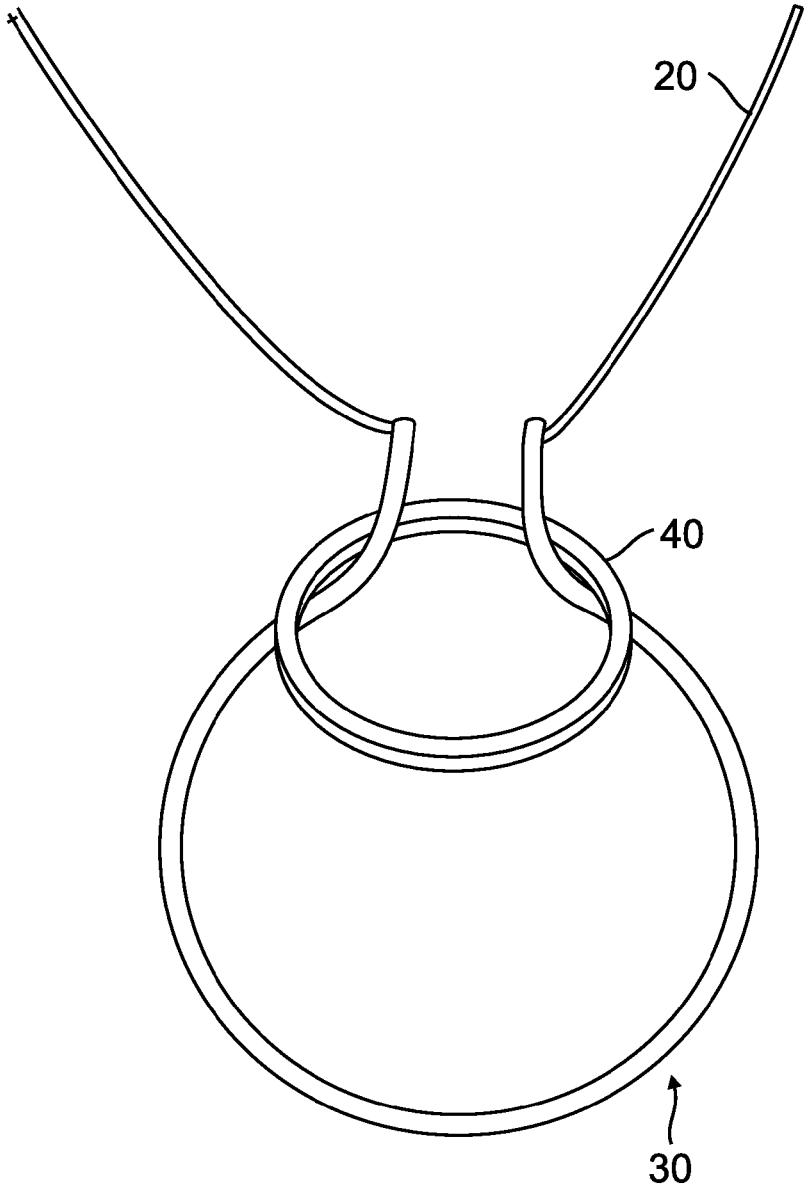
FIG. 6 is a plan view of the second preferred embodiment of the invention, with the ring attached.

FIG. 5 illustrates another preferred embodiment of the invention, in which the chain 20 is permanently attached or affixed to the wearable storage pendant 30. This embodiment includes a chain 20 which is attached at points 24 and 26 to the ends 39 of the wearable storage pendant 30. The jewelry ring 40 is attached to the wearable storage pendant 30 and chain 20 of the preferred embodiment of FIGS. 5-6 in the same manner as that used to secure the ring with the wearable storage pendant 30 and chain 20 shown in FIGS. 1-4. The attachment points 24 and 26 are preferably located at the ends of the pendant as shown in FIGS. 5 and 6, but may be located at any portion of the pendant consistent with this disclosure.

Figure 7:
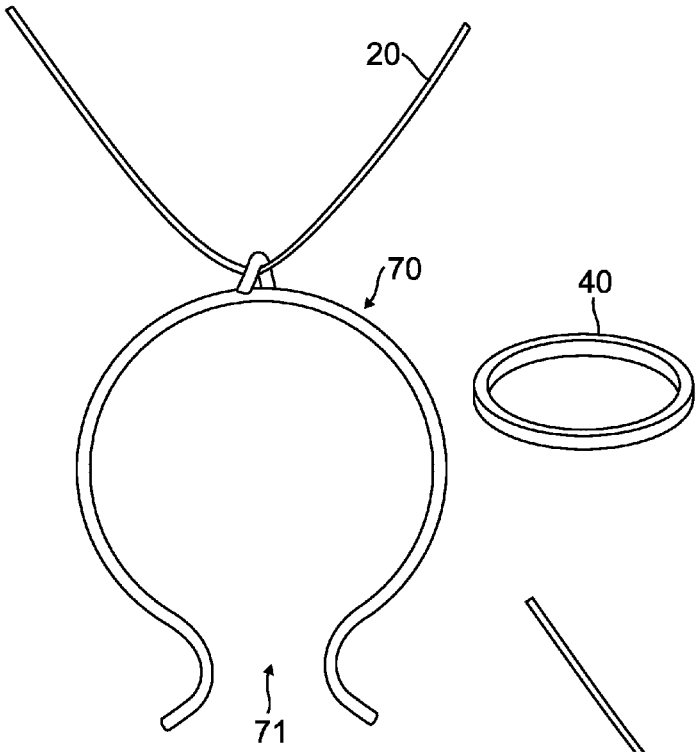
FIG. 7 is a plan view of a third preferred embodiment of the invention.
Figure 7A:
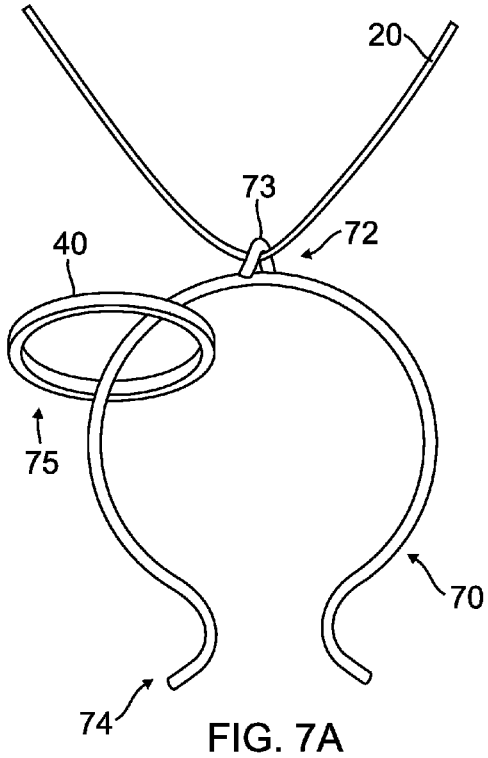
FIG. 7A is a plan view of the initial (first) stage of attaching a ring onto the third preferred embodiment of the invention.

In FIG. 7 there is shown a still further preferred embodiment of the wearable storage pendant 30 designated as 70, where the opening 71 onto which the jewelry ring 40 is threaded is away from rather than close to or attached to the chain 20. As shown in FIG. 7A, the chain 20 is attached to the wearable storage pendant 70 at its base. The chain 20 may have the wearable storage pendant 70 permanently affixed to one point of the chain 72, or be attached through an opening loop 73 such that the wearable storage pendant 70 can slide around on the chain 20. As illustrated in FIG. 7A, the open end 74 of the perimeter 75 of the wearable storage pendant 70 pierces the finger opening of jewelry ring 40. Jewelry ring 40 travels upward and around the body of the wearable storage pendant 70.

Figure 7B:
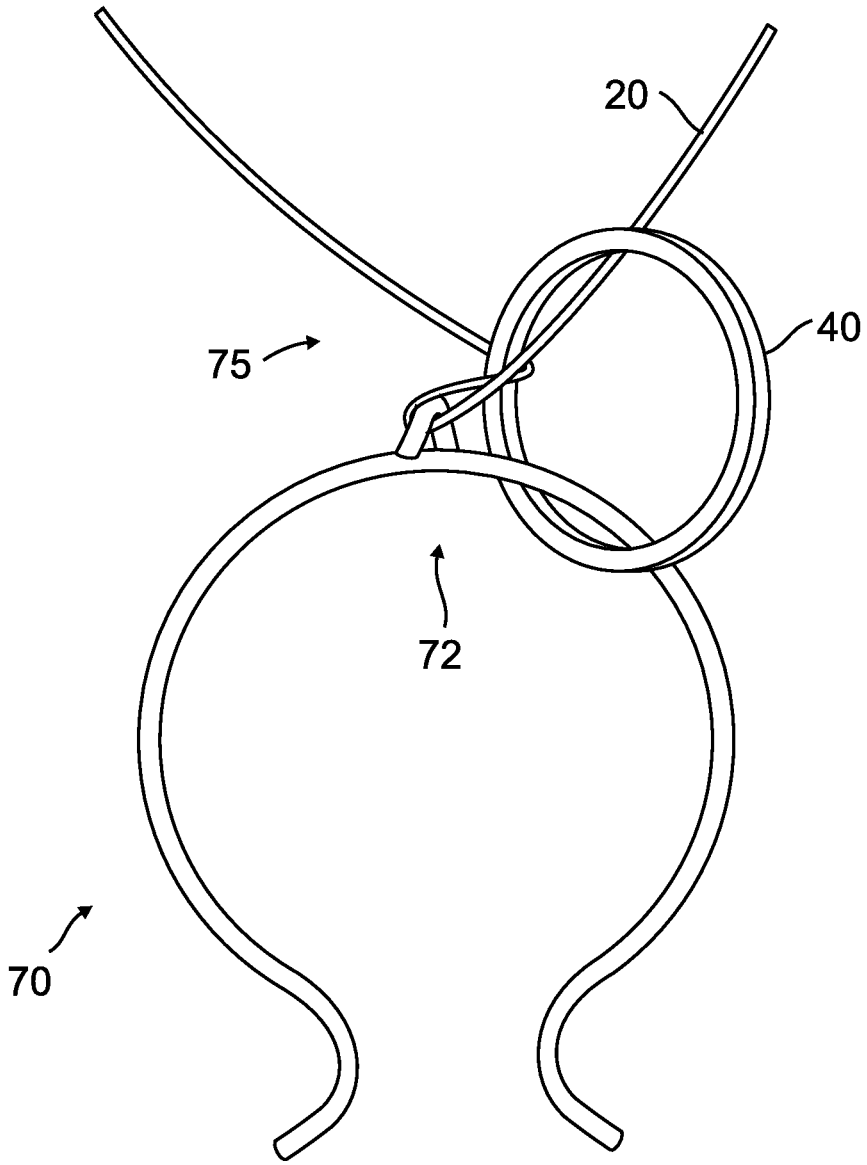
FIG. 7B is a plan view of the second stage of attaching a ring onto the third preferred embodiment of the invention.

As illustrated in FIG. 7B, once the jewelry ring 40 passes the attachment point 72 on the wearable storage pendant 70 where the wearable storage pendant 70 attaches to the chain 20, the chain 20 will need to flex so that the jewelry ring 40 can be manipulated to continue its travel around the perimeter 75 of the wearable storage pendant 70.

Figure 7C:
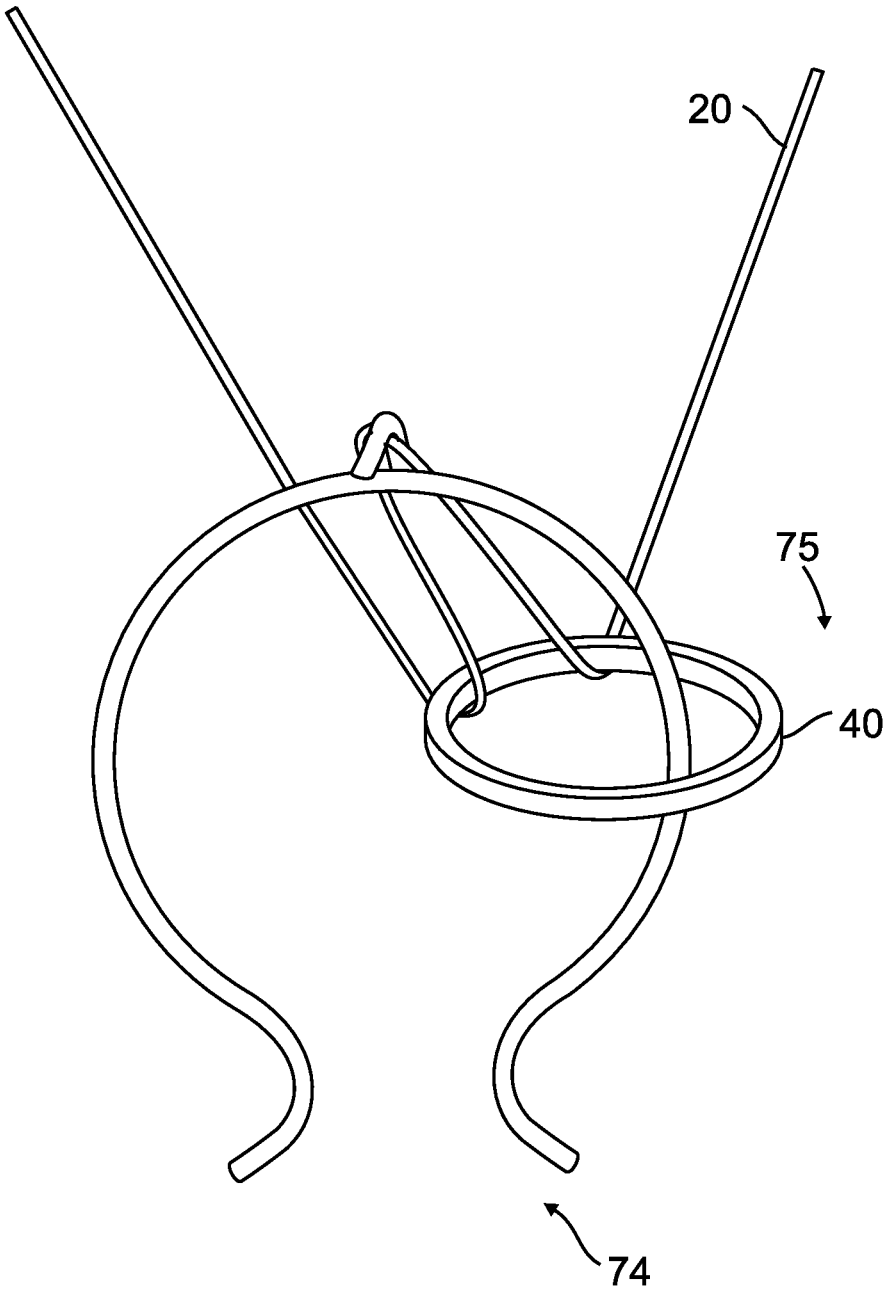
FIG. 7C is a plan view of the third stage of attaching a ring onto the third preferred embodiment of the invention.

As shown in FIG. 7C, the jewelry ring 40 travels all the way around the wearable storage pendant 70, manipulating the chain 20 in order to continue working its way completely around the perimeter 75. After the jewelry ring 40 passes the end 74 of the perimeter 75, the ring 40 will be captured between the wearable storage pendant 70 and the chain 20 as before.

Figure 8:
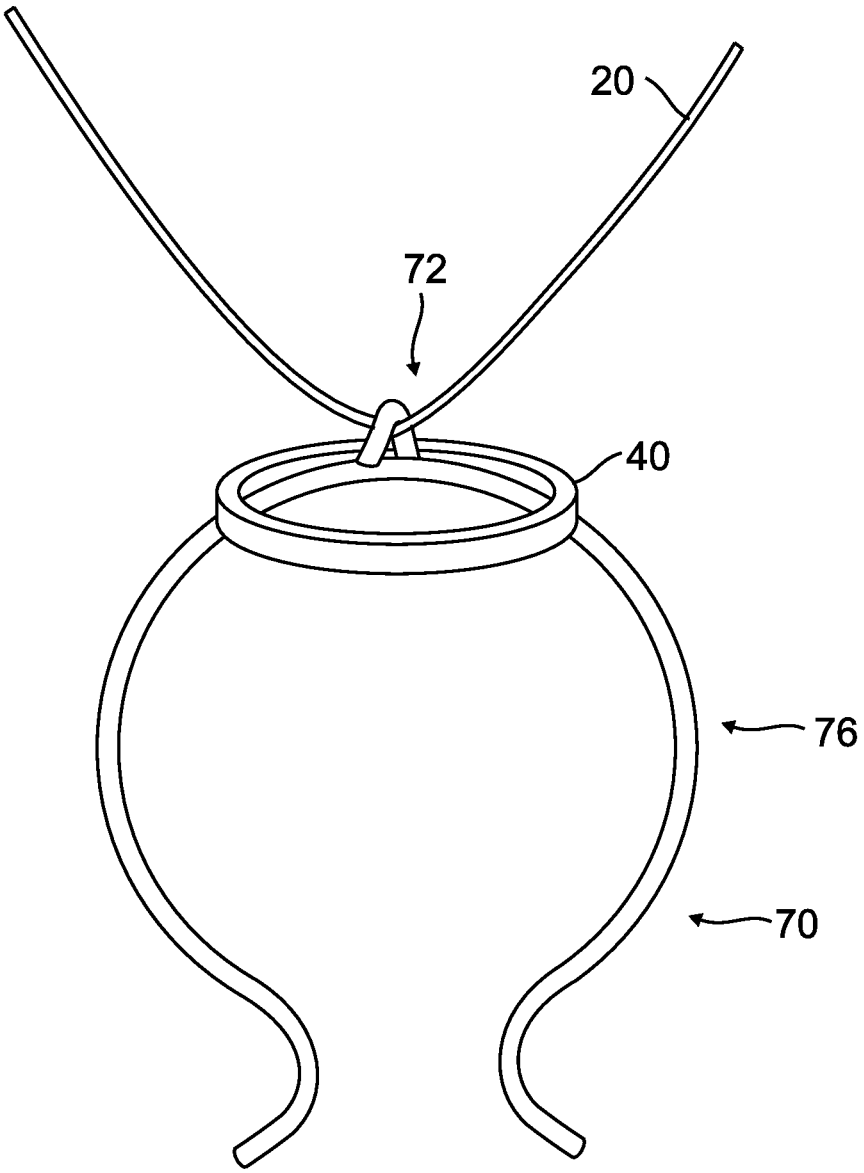
FIG. 8 is a plan view of the third preferred embodiment of the invention, with a ring attached.

FIG. 8 shows that the jewelry ring 40 is released to allow the chain 20 to return to its natural drape. This will cause the jewelry ring 40 to fall into place on or around the attachment point 72 of the wearable storage pendant 70. As with the first embodiment of the present invention, the widest part 76 of the wearable storage pendant 70 is wider than the inside diameter of the jewelry ring 40, and therefore the jewelry ring 40 rests securely on the wearable storage pendant 70. Precisely where the jewelry ring 40 comes to rest on the wearable storage pendant 70 will vary based on the size of the jewelry ring 40, but it will invariably come to rest on the part of the wearable storage pendant 70 that broadens from narrow to wide.

Figure 9:
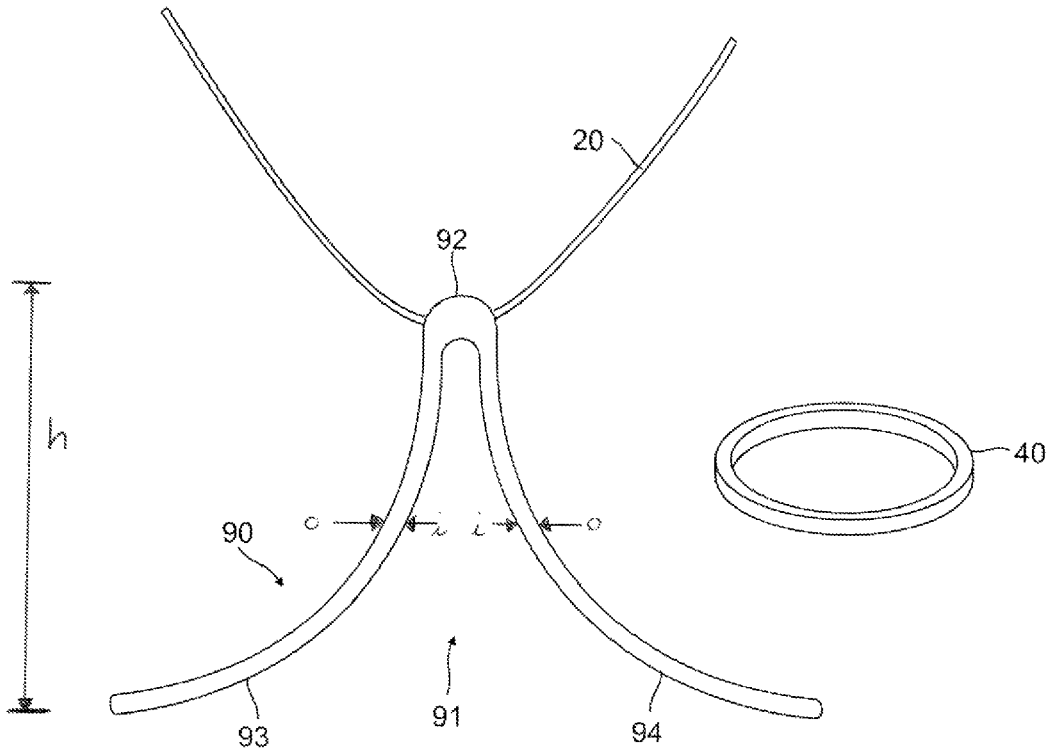
FIG. 9 is a plan view of a fourth preferred embodiment of the invention.
Figure 10:
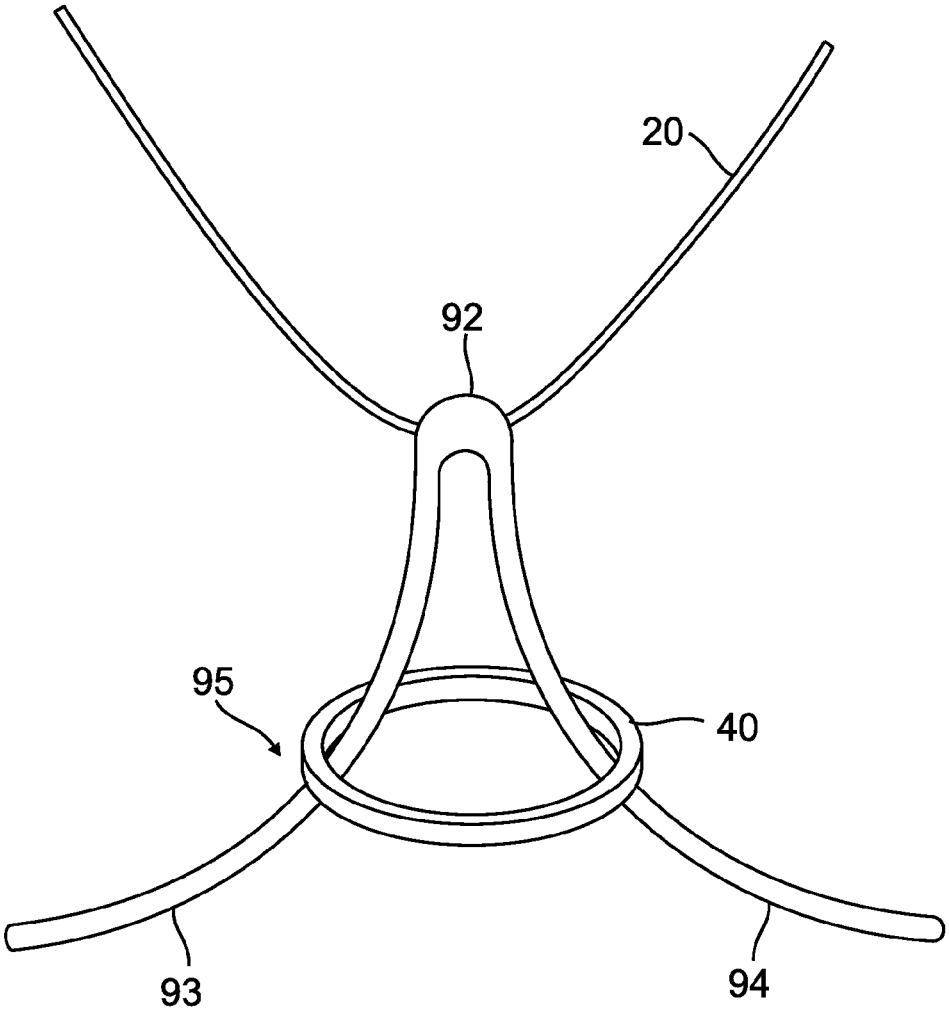
FIG. 10 is a plan view of the fourth preferred embodiment of the invention, with a ring attached.

FIGS. 9-10 illustrate another preferred embodiment of the wearable storage pendant 90. It is similar to the previous embodiment of wearable storage pendant 70 as its opening 91 is opposite the point of attachment 92 of the chain 20. A chain 20 is attached to the body of the pendant at 92. The pendant may either be permanently attached or affixed to one point on the chain, or be attached by virtue of passing through an opening or loop on the body of the pendant, such that the pendant can slide around on the chain. The jewelry ring 40 is attached to the wearable storage pendant 90 and chain 20 of the preferred embodiment of FIGS. 9-10 in the same manner as that used to secure the ring with the wearable storage pendant 70 and chain 20 shown in FIGS. 7-8. That is, the ring 40 slides over one end 93 of the opening of the wearable storage pendant 90 and travels up and over the attachment point 92. The ring 40 then continues sliding down the other side of the wearable storage pendant until it passes over the opposite end 94 of the pendant 90. Upon passing completely over the opposite end 94, the ring 40 will be captured by the chain 20, and can be safely released. The ring will come to rest at a wide point 95 on the wearable storage pendant, in the same manner as in previous embodiments.

As further shown in FIG. 9, pendant 90 is an elongated member having a vertical dimension "h" (height) with a top portion attached to chain 20 and a bottom portion in which the two ends 93 and 94 of the elongate member are disposed. At a given vertical level, there is an inner lateral dimension between laterally opposite (opposing) portions of the elongated member (e.g., the distance between inner arrowheads "i" in FIG. 9) and an outer lateral dimension between them (e.g., the distance between arrowheads "o" in FIG. 9).

An additional limitation of the prior art is that when the jewelry ring 40 is placed on the jewelry storage device, the ring tends to protrude away from the wearer's body. This is not only unattractive, but can be bothersome or even dangerous. The embodiment of the wearable storage pendant 30 shown in FIG. 11 eliminates the problem of the jewelry ring 40 lying in an uncomfortable or unattractive manner on the wearer's body. The wearable storage pendant 30 in this embodiment has one or more indentations or curvatures on the pendant that allow the ring to lie substantially flat against the wearer's body.

In the preferred embodiment, the wearable storage pendant 30 has a first curvature 110 located below the upper (top) end 35 of the wearable storage pendant. The first curvature is preferably 225 located on the posterior face (back side) 111 of the wearable storage pendant, or the portion of the wearable storage pendant 30 that is generally in contact with the wearer's body. A second curvature 120 may be located on the anterior face (front side) 121 of the wearable storage pendant 30 to further allow the ring to lie generally in a plane with the pendant. A person of skill in the art would recognize that additional curvatures may be added to the pendant in a manner consistent with this invention.

Figure 12:
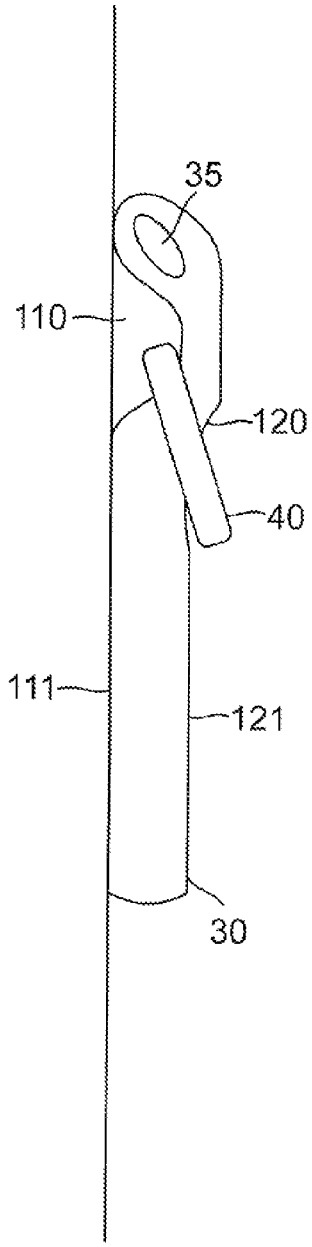
FIG. 12 is a side view of the first preferred embodiment of the invention, with a ring attached.

As shown in FIG. 12, when the ring 40 comes to rest after being threaded through the wearable storage pendant 30 as described above, the upper portion of the ring 40 rests in the first curvature 110, while the lower portion of the ring 40 rests in the second curvature 120. By so doing, the ring assumes the general alignment of the pendant, which in turn is generally in alignment with the wearer's body. Because the ring is substantially flat against the wearer's body, the wearable storage pendant 30 and ring 40 can be worn without obvious and unflattering lumps under the wearer's clothes, and without the inconvenience and danger that might come with the ring 40 potentially snagging due to the angle at which it would extend from the wearer's body under the prior art devices.

Figure 11:
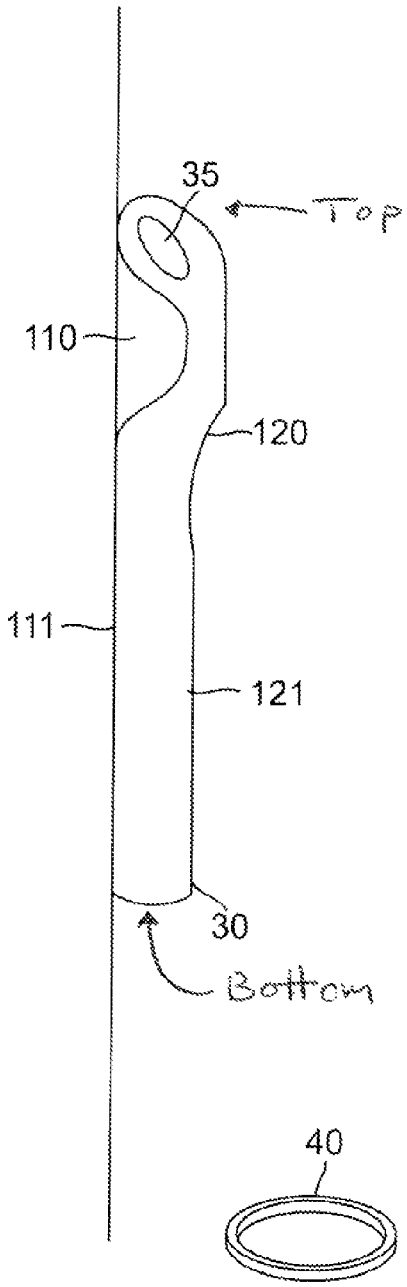
FIG. 11 is a side view of the first preferred embodiment of the invention.

Although the embodiment shown in FIGS. 11 and 12 describes a wearable storage pendant with two curvatures, a person of skill in the art would understand that the wearable storage pendant may incorporate more than two curvatures in order to better accommodate different sizes or shapes of rings. Likewise the invention may incorporate curvatures not only on the posterior and anterior faces of the wearable storage pendant, but also on the lateral faces of the wearable storage pendant as appropriate.

Finally, a person of skill in the art would appreciate that the preferred embodiments of the present invention are adaptable to any number of shapes or designs of the wearable storage pendant 30 and 70 consistent with the disclosure and purpose of the invention herein.

What is claimed is:

1. A wearable storage device for securing a jewelry ring having a band defining an inner diameter, comprising:

a chain; and a pendant consisting essentially of an elongated member having a first end and a second end, the elongated member curved in a plane such that portions of the member are laterally opposite each other, each laterally opposite portion having an inward-facing side and an outward-facing side, the pendant having a vertical dimension with a top portion and a bottom portion, a front side, a back side and a lateral profile formed by the elongated member, wherein the chain is attached to the top portion of the pendant at both the first end and the second end of the elongated member, wherein a lateral distance between the outward-facing sides of the laterally opposite portions of the elongated member at the top portion of the pendant is narrower than a lateral distance between the outward-facing sides of the laterally opposite portions of the elongated member at a vertical level below the top portion, whereby the pendant is able to retain the jewelry ring such that the band encircles the laterally opposite portions of the elongated member at the top portion of the pendant but the inner diameter of the band is smaller than the lateral distance between the outward-facing sides of the laterally opposite portions of the elongated member at the lower vertical level, and wherein the back side of the pendant has a concavity sized and configured to permit the jewelry ring to rest at least substantially parallel to the plane when the jewelry ring encircles the laterally opposite portions of the elongated member.

2. The wearable storage device of claim 1, wherein the chain is immovably secured to the pendant.

3. The wearable storage device of claim 1, wherein the pendant has a bottle-shaped profile.

4. The wearable storage device of claim 1, further comprising:

the jewelry ring having the band defining the inner diameter, wherein the jewelry ring encircles the laterally opposite portions of the elongated member above the lower vertical level.

5. The wearable storage device of claim 4, wherein the band of the ring is at least partially inserted in the concavity such that the ring assumes an at least substantially vertical orientation.

* * * * *